US007513732B1

(12) United States Patent
Callens

(10) Patent No.: US 7,513,732 B1
(45) Date of Patent: Apr. 7, 2009

(54) LOADER ATTACHMENT SYSTEM

(76) Inventor: Albert C. Callens, 3362 260th Ave., Taunton, MN (US) 56291

( * ) Notice: Subject to any disclaimer, the term of this patent is extended or adjusted under 35 U.S.C. 154(b) by 172 days.

(21) Appl. No.: 11/669,548

(22) Filed: Jan. 31, 2007

(51) Int. Cl.
*E02F 3/00* (2006.01)

(52) U.S. Cl. ..... 414/723; 37/468

(58) Field of Classification Search ..... 414/723; 37/468; 403/322.4, 323
See application file for complete search history.

(56) References Cited

U.S. PATENT DOCUMENTS

| | | | | |
|---|---|---|---|---|
| 3,794,195 | A | 2/1974 | Clevenger et al. | |
| 4,117,944 | A | 10/1978 | Beckstrom et al. | |
| 5,098,252 | A | 3/1992 | Sheesley et al. | |
| 5,403,144 | A | 4/1995 | Staben, Jr. | |
| 5,562,397 | A | 10/1996 | Albright | |
| 5,836,734 | A * | 11/1998 | Doering | 414/723 |
| 6,238,130 | B1 * | 5/2001 | Youngers | 403/322.4 |
| 6,332,748 | B1 * | 12/2001 | Doering et al. | 414/723 |
| 6,390,765 | B1 | 5/2002 | Dick | |
| 6,499,934 | B1 | 12/2002 | Kaczmarski et al. | |
| 6,619,906 | B2 | 9/2003 | Dick | |
| 6,729,830 | B2 | 5/2004 | Wagner et al. | |
| 6,851,916 | B2 | 2/2005 | Schmidt | |
| 6,860,707 | B2 | 3/2005 | Roan et al. | |
| 6,896,088 | B2 | 5/2005 | Dahl et al. | |

OTHER PUBLICATIONS

Bobcat Company, "Bucket Attachment Brochure".

* cited by examiner

*Primary Examiner*—Donald Underwood

(57) ABSTRACT

A loader attachment system for efficiently attaching an implement (i.e. bucket, etc.) to a skid steer loader or other similar use vehicle. The loader attachment system generally includes an upper assembly including an upper end and a lower end, wherein the upper assembly is pivotally attached to a mounting plate, a sleeve attached to the mounting plate, a plunger pivotally attached to the lower end of the upper assembly, wherein the plunger extends within the sleeve and wherein the plunger slidably adjusts within the sleeve and a first spring mechanically connected between the upper assembly and the mounting plate. The first spring mechanically rotates the plunger within the sleeve via rotation of the upper assembly.

13 Claims, 8 Drawing Sheets

LOADER ATTACHMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to skid steer loaders and more specifically it relates to a loader attachment system for efficiently attaching an implement (i.e. bucket, backhoe, etc.) to a skid steer loader or other similar use vehicle.

2. Description of the Related Art

Any discussion of the prior art throughout the specification should in no way be considered as an admission that such prior art is widely known or forms part of common general knowledge in the field.

Skid steer loaders and the use of attachment mechanisms to quickly and efficiently attach implements (i.e. buckets, backhoe, etc.) have been in use for years. The attachment mechanisms are generally referred to as a quick attachment device and may also be known to sell under various names such as BOBTACH. The attachment mechanisms are generally attached to the front of a skid steer loader and are utilized to attach various implements (i.e. buckets, backhoes, grapples, etc.) to the skid steer loader by extending a plunger mechanism through aligning slots of the skid steer loader and the implement.

Generally the plunger mechanism that connects the implement to the skid steer loader is comprised of a wedge or similar shaped configuration. Utilizing the wedge shape is generally efficient during normal/light use of the implement; however when utilizing a backhoe along with a substantial load the wedge may allow the implement to slip off of the connecting plunger and skid steer loader.

The problem with the wedge allowing the implement to become disconnected from the skid steer loader is especially prevalent when utilizing a backhoe and when a sufficient force is applied in the direction that the skid steer loader is facing. Because of the general lack of efficiency and practicality in the prior art there is the need for a new and improved loader attachment system for efficiently attaching an implement (i.e. bucket, backhoe, etc.) to a skid steer loader or other similar use vehicle.

BRIEF SUMMARY OF THE INVENTION

The general purpose of the present invention is to provide a loader attachment system that has many of the advantages of the skid steer loaders mentioned heretofore. The invention generally relates to a skid steer loaders which includes an upper assembly including an upper end and a lower end, wherein the upper assembly is pivotally attached to a mounting plate, a sleeve attached to the mounting plate, a plunger pivotally attached to the lower end of the upper assembly, wherein the plunger extends within the sleeve and wherein the plunger slidably adjusts within the sleeve and a first spring mechanically connected between the upper assembly and the mounting plate. The first spring mechanically rotates the plunger within the sleeve via rotation of the upper assembly.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a loader attachment system for efficiently attaching an implement (i.e. bucket, etc.) to a skid steer loader or other similar use vehicle.

Another object is to provide a loader attachment system that loader attachment system for efficiently attaching an implement (i.e. bucket, backhoe, etc.) to a skid steer loader or other similar use vehicle.

An additional object is to provide a loader attachment system that prevents the implement (i.e. bucket, backhoe, grapple, etc.) from becoming disconnected from the skid steer loader during use.

A further object is to provide a loader attachment system that is adaptable and may be utilized with various skid steer loaders and implements.

Another object is to provide a loader attachment system that allows for easy attachment of the implement to the skid steer loader.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
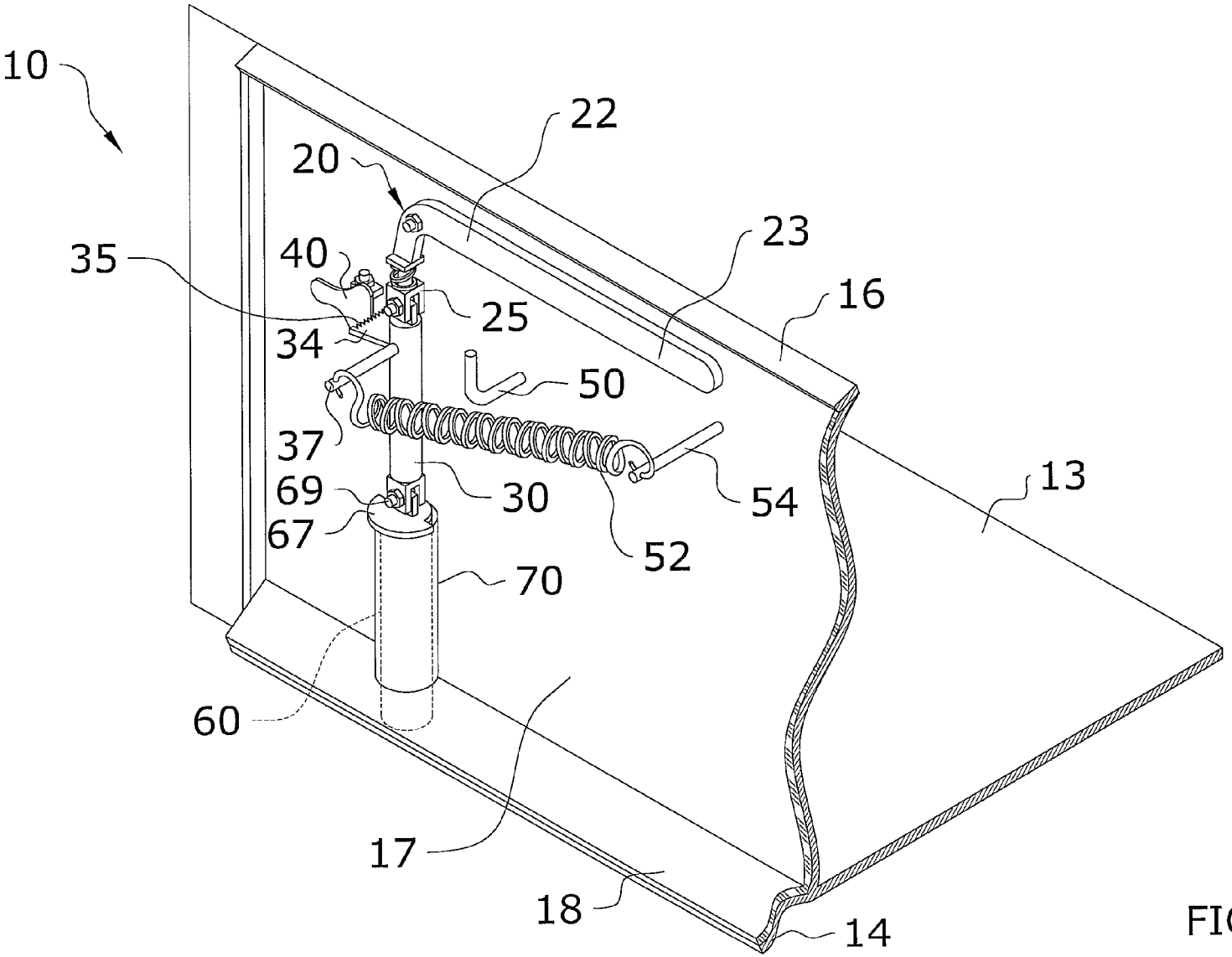
FIG. 1 is an upper perspective view of the present invention attaching the mounting plate to the loader implement.

Turning now descriptively to the drawings, in which similar reference characters denote similar elements throughout the several views, FIGS. 1 through 4 illustrate a loader attachment system 10, which comprises an upper assembly 20, 20' including an upper end and a lower end, wherein the upper assembly 20, 20' is pivotally attached to a mounting plate 17, a sleeve 70, 70' attached to the mounting plate 17, a plunger 60, 60' pivotally attached to the lower end of the upper assembly 20, 20', wherein the plunger 60, 60' extends within the sleeve 70, 70' and wherein the plunger 60, 60' slidably adjusts within the sleeve 70, 70' and a first spring mechanically connected between the upper assembly 20, 20' and the mounting plate 17. The first spring mechanically rotates the plunger 60, 60' within the sleeve 70, 70' via rotation of the upper assembly 20, 20'.

Figure 3A:
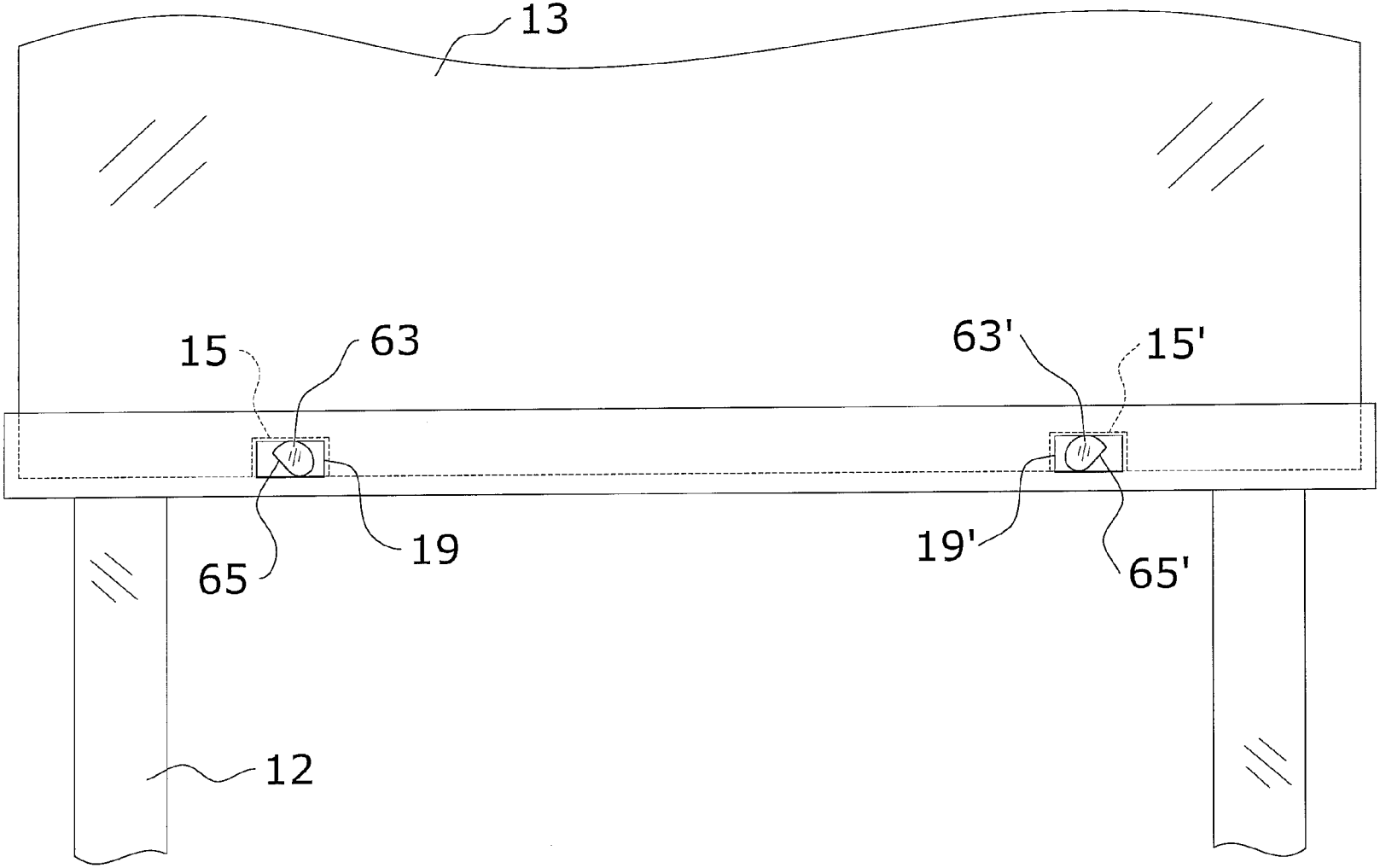
FIG. 3*a* is a bottom view of the present invention in the secured position, wherein the mounting plate is attached to the loader implement.
Figure 3B:
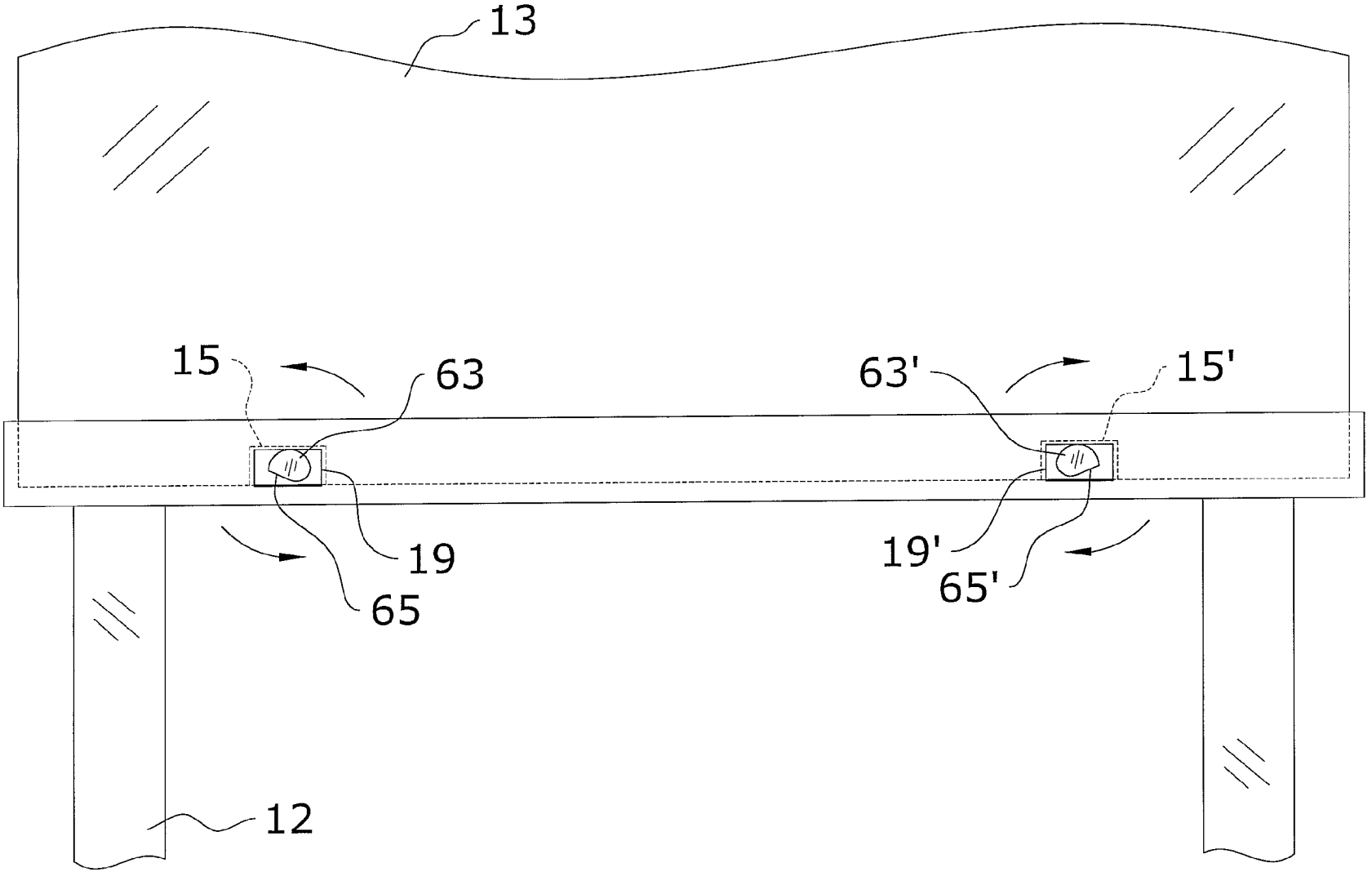
FIG. 3*b* is a bottom view of the present invention in a half way position, wherein the mounting plate is partially attached to the loader implement.
Figure 3C:
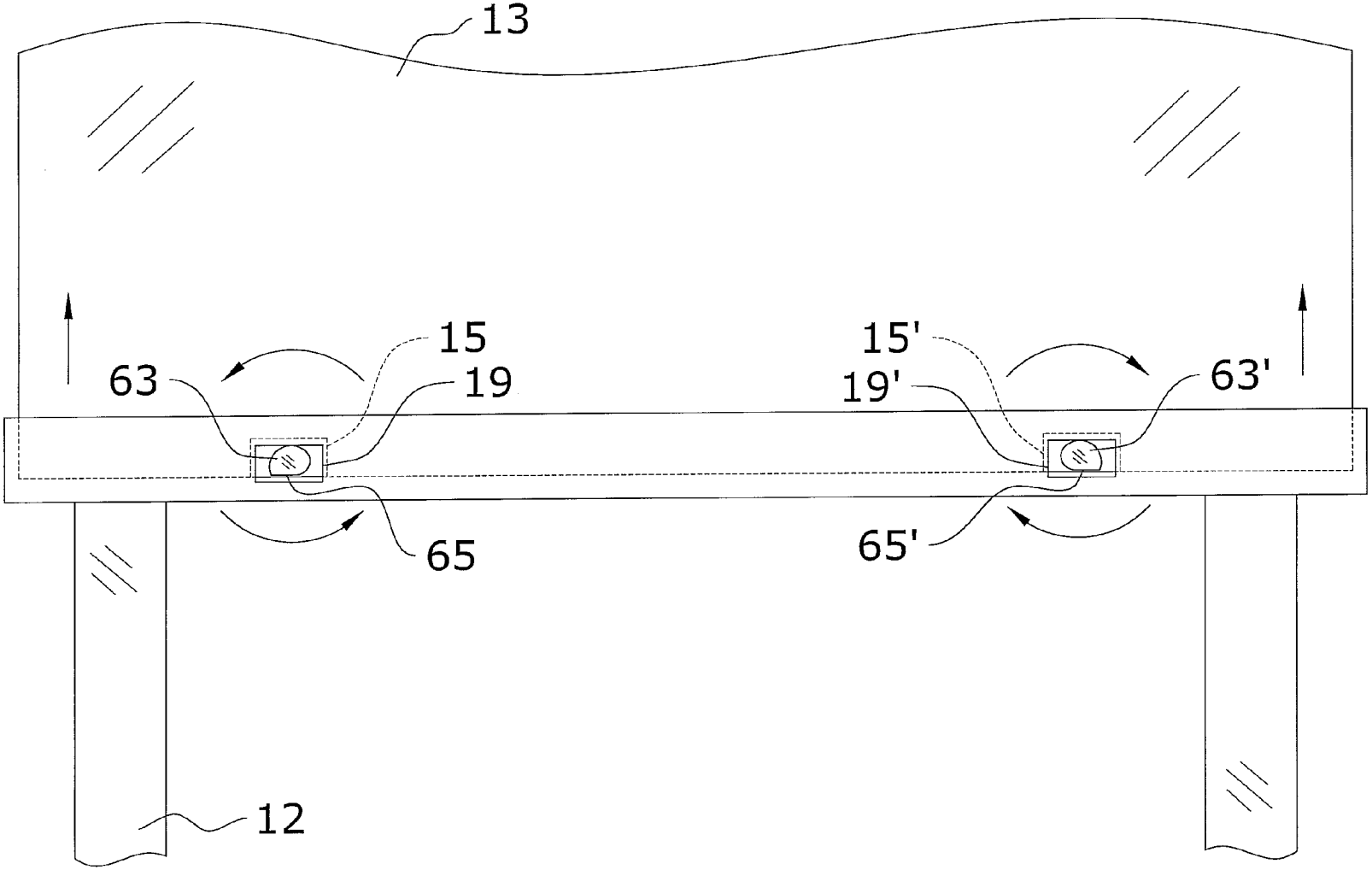
FIG. 3*c* is a bottom view of the present invention in an open position, wherein the mounting plate is unattached to the loader implement.
Figure 4:
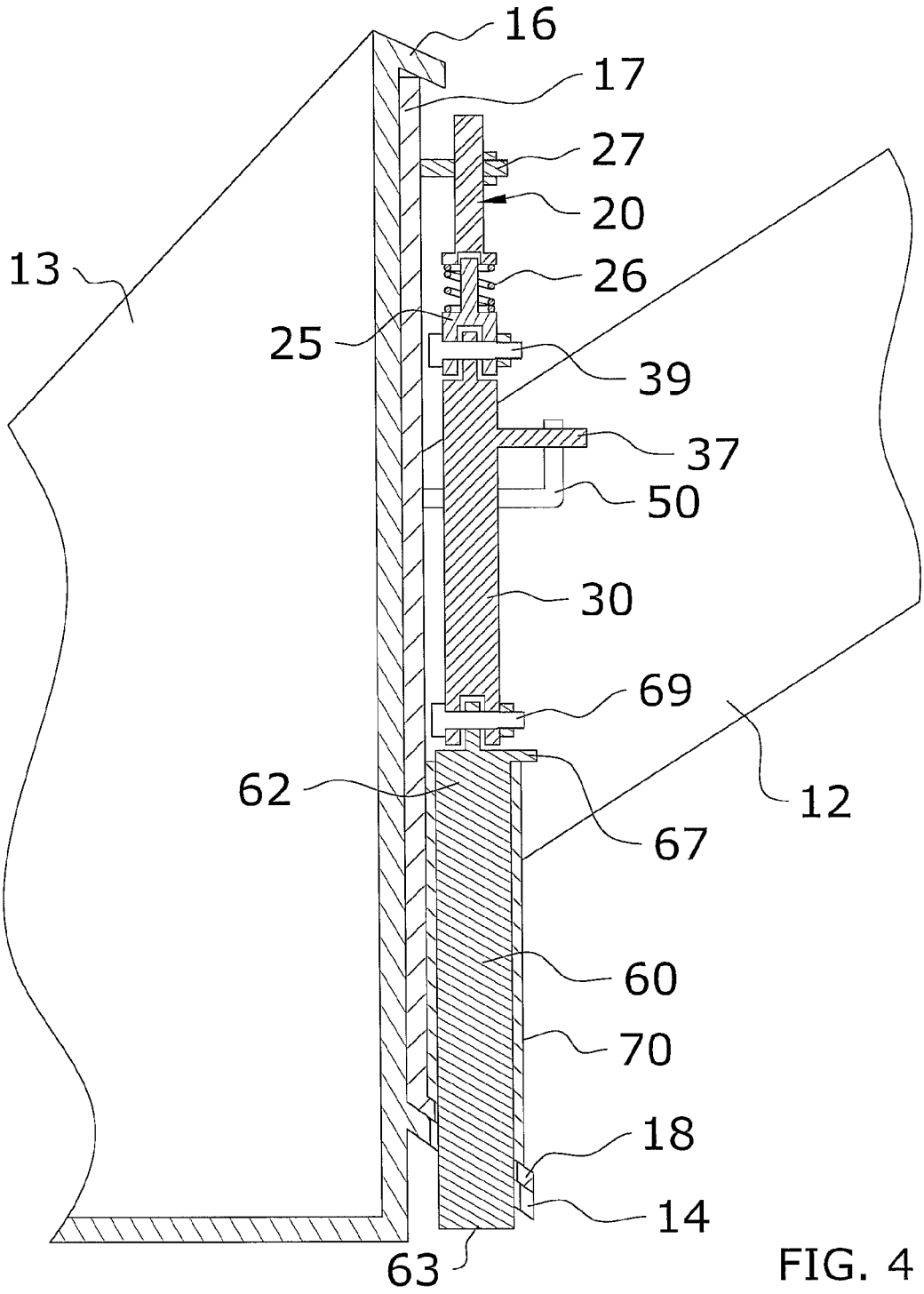
FIG. 4 is a cross sectional view of the present invention in the secured position, wherein the mounting plate is attached to the loader implement.

The present invention is preferably attached upon a mounting plate 17 of a skid steer loader. The mounting plate 17 is generally attached to the loader arms 12 of the skid steer loader, wherein the skid steer loader is able to pivot/elevate/lower the mounting plate 17. The mounting plate 17 of the skid steer loader is further preferably comprised of a standard mounting plate 17 upon a skid steer loader. The mounting plate 17 preferably includes a first flange 18 extending inwardly from a lower bottom edge of the mounting plate 17 as shown in FIGS. 3*a* through 4. The first flange 18 preferably includes a pair of first slots 19, 19' positioned about opposing ends. The first flange 18 and the first slots 19, 19' are preferably standard upon mounting plates 17 of skid steer loaders.

The present invention attaches a loader implement 13 (i.e. bucket, backhoe, grapple, etc.) to the mounting plate 17 of the skid steer loader. The loader implement 13 is preferably comprised of a standard structure common in the art of loader implements 13. The loader implement 13 includes a second flange 14 extending outwardly toward the mounting plate 17 and along a lower edge of the loader implement 13 as shown in FIGS. 3*a* through 4. The first flange 18 and the second flange 14 also preferably extend at a downward angle away from the mounting plate 17 and the loader implement 13 respectfully. The second flange 14 also includes a pair of second slots 15, 15' to align with the first slots of the first flange 18. The loader implement 13 also preferably includes a retainer portion 16 extending outwardly from a top edge of the implement as shown in FIGS. 1 and 4. The retainer portion 16 helps to secure the mounting plate 17 to the loader implement 13.

The skid steer loader preferably utilizes a pair of loader attachment systems 10 to attach the loader implement 13 to the mounting plate 17 of the skid steer loader. In the below description the loader attachment system 10 is described as one unit; however it is to be understood that a pair of loader attachment systems 10 are generally utilized together as illustrated in FIGS. 2*a* through 3*c*. The loader attachment systems 10 also preferably mirror each other upon the mounting plate 17.

B. Upper Assembly

Figure 2A:
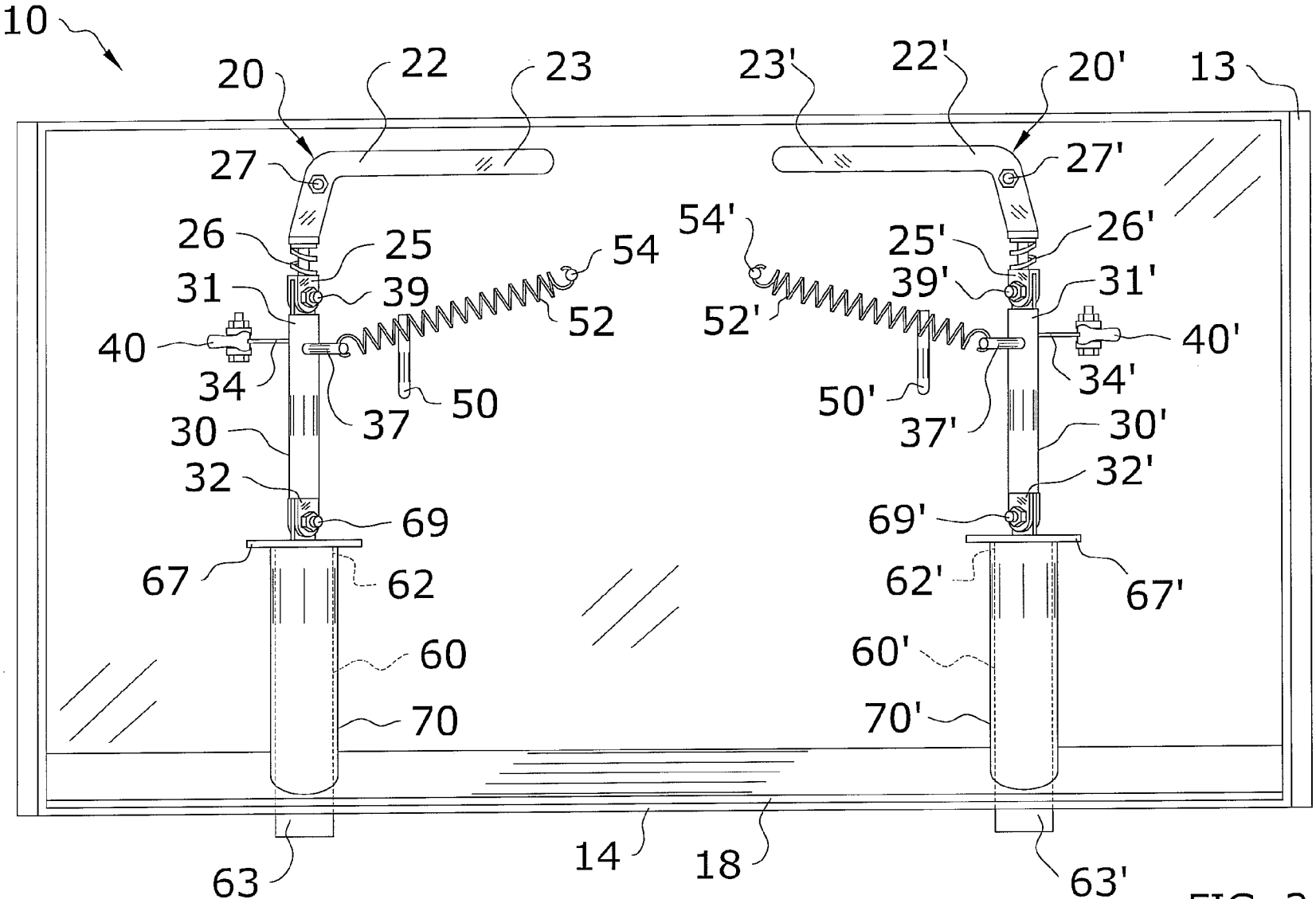
FIG. 2*a* is a rear view of the present invention in the secured position, wherein the mounting plate is attached to the loader implement.
Figure 2B:
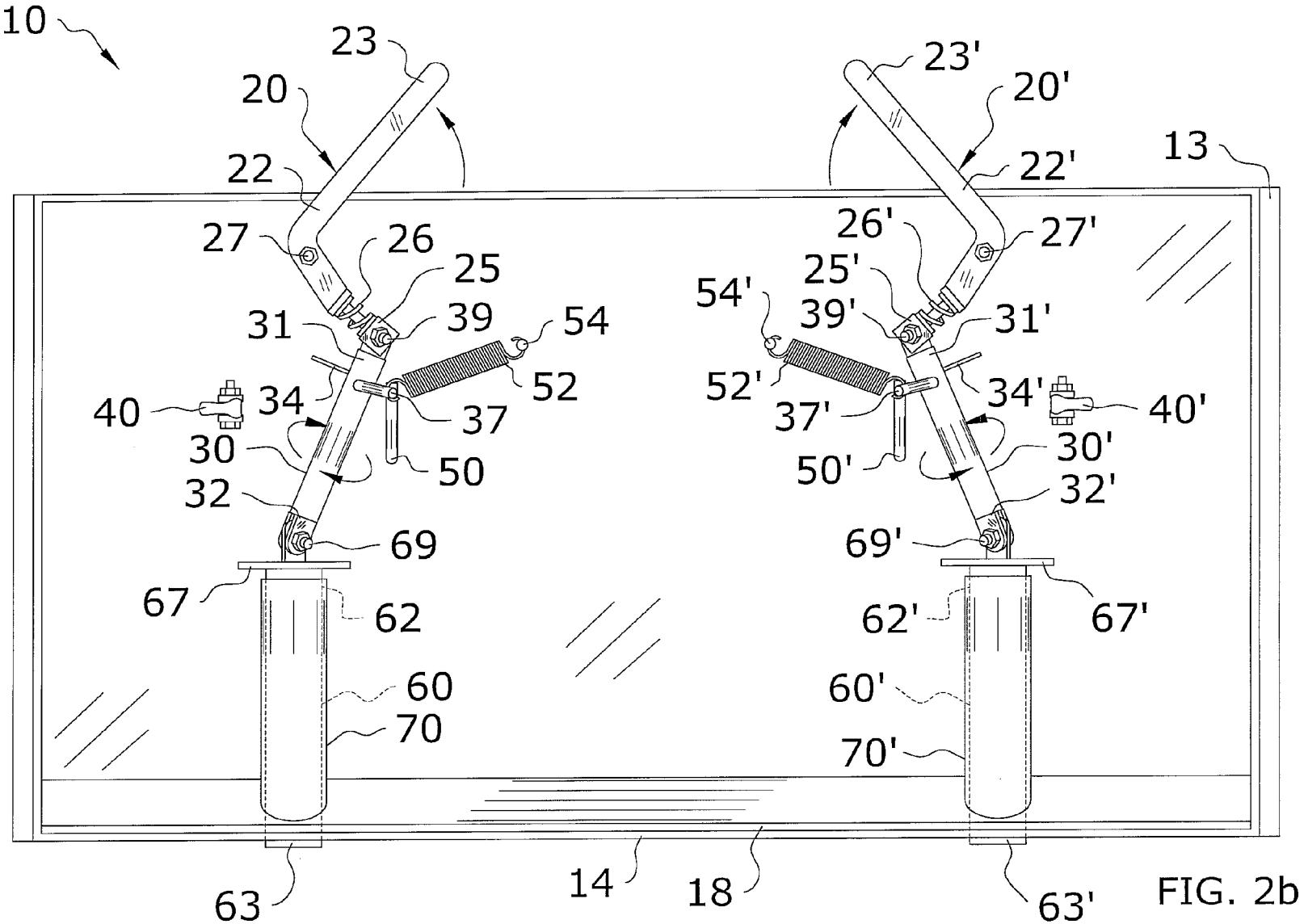
FIG. 2*b* is a rear view of the present invention in a half way position, wherein the mounting plate is partially attached to the loader implement.
Figure 2C:
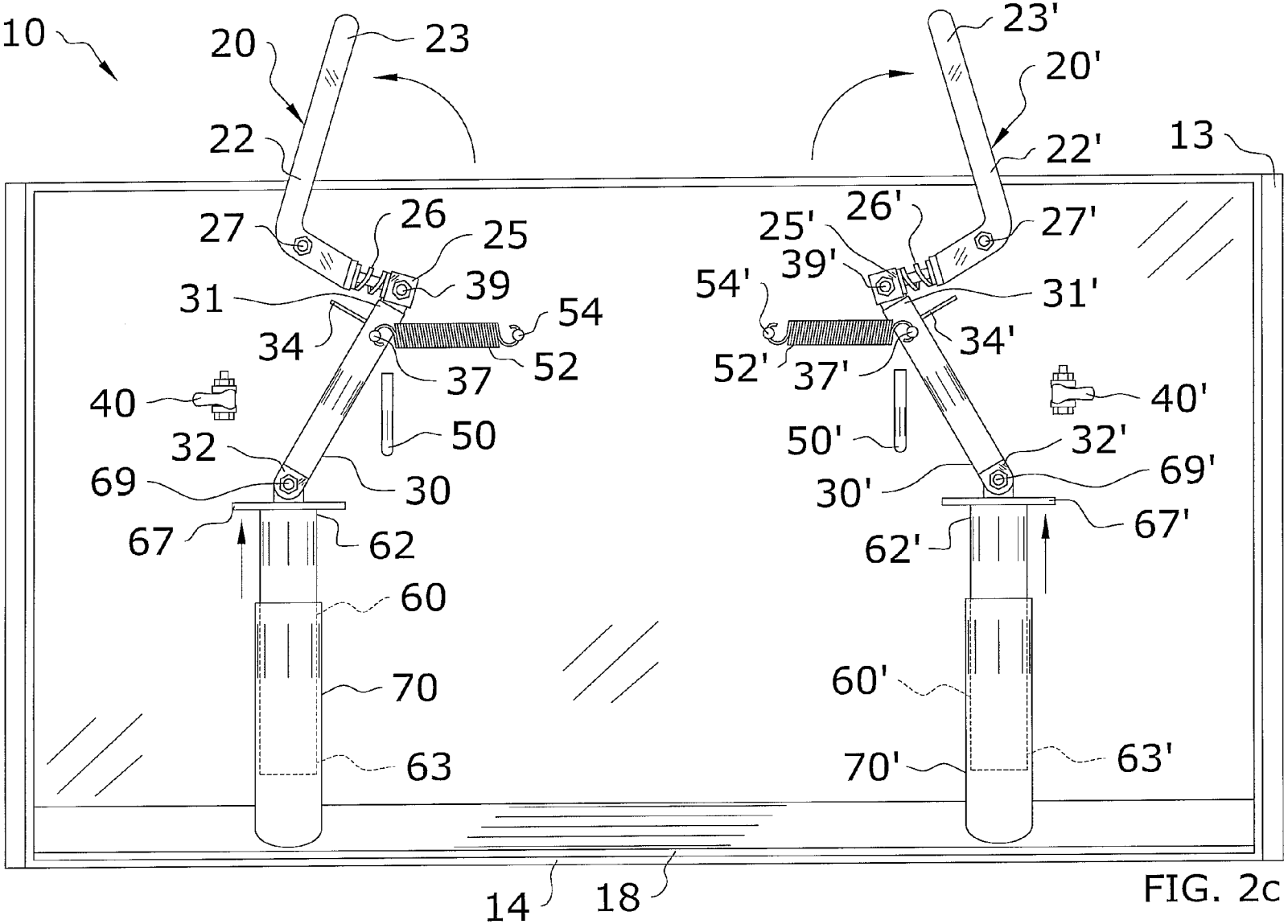
FIG. 2*c* is a rear view of the present invention in an open position, wherein the mounting plate is unattached to the loader implement.

The upper assembly 20, 20' is comprised of a series of parts interconnected together to provide a vertical and rotational force upon the plunger 60, 60'. The upper assembly 20, 20' is pivotally attached to the mounting plate 17 as shown in FIGS. 2*a* through 2*c*. The upper assembly 20, 20' is comprised of a durable structure to provide an effective attaching force of the mounting plate 17 and the loader implement 13. The upper assembly 20, 20' is also preferably comprised of a durable material to withstand harsh weather conditions and extended use.

The upper assembly 20, 20' also includes an upper end and a lower end. In the following description the upper end will be referred to as the lever 22, 22' and the lower end will be referred to as the connecting member 30, 30'. It is appreciated that other embodiments of the upper end and the lower end may be utilized with the present invention.

The lever 22, 22' is pivotally attached to the mounting plate 17 via a first fastener 27, 27' as shown in FIGS. 2*a* through 2*c*. The first fastener 27, 27' forms a first pivot axis upon the present invention. The lever 22, 22' may be comprised of a plurality of configurations. In the preferred embodiment of the present invention the lever 22, 22' is comprised of an L-shaped configuration. The lever 22, 22' includes a handle portion 23, 23' and an attachment portion 25, 25'. The handle portion 23, 23' and the attachment portion 25, 25' are positioned about opposing ends of the lever 22, 22'.

The attachment portion 25, 25' of the lever 22, 22' is preferably rotatable upon the lever 22, 22', wherein the attachment portion 25, 25' attaches the lever 22, 22' to the connecting member 30, 30'. The attachment portion 25, 25' of the lever 22, 22' is further slidable within the lever 22, 22' to allow the locking spring 26, 26' to compress about the attachment portion 25, 25'. The connecting member 30, 30' further rotates about the lever 22, 22' via the attachment portion 25, 25'.

The attachment portion 25, 25' also preferably includes a locking spring 26, 26' positioned between the lever 22, 22' and the connecting member 30, 30'. When the present invention is in the secured position the locking spring 26, 26' preferably provides an upward force upon the lever 22, 22' offset of the first fastener 27, 27' and the first pivot axis as shown in FIG. 2*a*. The offset upward force helps to maintain the lever 22, 22' in the secured position.

The connecting member 30, 30' may be comprised of various configurations. In the preferred embodiment the connecting member 30, 30' is comprised of a cylindrical configuration. The connecting member 30, 30' includes a first connecting end 31, 31' and a second connecting end 32, 32' opposite the first connecting end 31, 31' as shown in FIGS. 1 through 2*c*. The first connecting end 31, 31' is preferably pivotally attached to the attachment portion 25, 25' of the upper assembly 20, 20' via a second fastener 39, 39'. The second fastener 39, 39' forms a second pivot axis upon the present invention as shown in FIGS. 2*a* through 2*c*.

The connecting member 30, 30' preferably includes a stopper member 34, 34' extending outwardly toward an outer end of the mounting plate 17 as shown in FIGS. 1 through 2*c*. The stopper member 34, 34' is preferably perpendicularly positioned upon the connecting member 30, 30'. The stopper member 34, 34' is also preferably comprised of a plate structure and includes a securing portion 35, 35' upon an outer end of the stopper member 34, 34'. The securing portion 35, 35' may be comprised of various configurations. In the preferred embodiment the securing portion 35, 35' is comprised of a saw toothed configuration as shown in FIG. 1.

The connecting member 30, 30' also includes an arm member 37, 37' extending outwardly toward the skid steer loader as shown in FIGS. 1 through 2*c*. The arm member 37, 37' is preferably perpendicularly positioned upon the connecting member 30, 30'. The arm member 37, 37' is also preferably perpendicularly positioned with respect to the stopper member 34, 34'. The arm member 37, 37' is also preferably comprised of a tubular structure. The arm member 37, 37' and the stopper member 34, 34' are preferably positioned substantially adjacent to the first connecting end 31, 31' as shown in FIGS. 1 through 2*c*.

A rotator spring 52, 52' is attached between the arm member 37, 37' and the mounting plate 17 as shown in FIGS. 1 through 2*c*, wherein the rotator spring 52, 52' is attached to the mounting plate 17 by an attachment member 54, 54'. The rotator spring 52, 52' pulls on the arm member 37, 37' and thus rotates the connecting member 30, 30' and attached plunger 60, 60' when the present invention is adjusting from the open position to the secured position.

The second connecting end 32, 32' of the connecting member 30, 30' is preferably substantially similar in configuration to the first connecting end 31, 31'. The second connecting end 32, 32' pivotally attaches the connecting member 30, 30' to the plunger 60, 60' as shown in FIGS. 1 through 2*c*.

C. Catch Member

The catch member 40, 40' is preferably fixedly attached to the mounting plate 17. The catch member 40, 40' is also preferably positioned between the connecting member 30, 30' and the outer edge of the mounting plate 17 as shown in FIGS. 1 through 2*c*. The catch member 40, 40' may be comprised of a plurality of configurations all which adequately receive and secure the securing portion 35, 35' of the stopper member 34, 34'. The catch member 40, 40' prevents the connecting member 30, 30' from rotating when the present invention is in the closed position, wherein the teeth of the securing portion 35, 35' secure the stopper member 34, 34' about catch member 40, 40'.

D. Guide Member

The guide member 50, 50' is preferably fixedly attached to the mounting plate 17. The guide member 50, 50' is also preferably positioned between the connecting member 30, 30' and the center of the mounting plate 17 as shown in FIGS. 1 through 2*c*. The guide member 50, 50' may be comprised of a plurality of configurations. The guide member 50, 50' is preferably comprised of a tubular structure, wherein the guide member 50, 50' is comprised of an L-shaped configuration. The guide member 50, 50' is also preferably slightly curved to allow clearance of the connecting member 30, 30' when adjusting from the secured position to the open position or vice versa.

The arm member 37, 37' engages the guide member 50, 50' as the present invention is moving from the secured position to the open position as illustrated in FIGS. 2*a* through 2*c*. The guide member 50, 50' forces the connecting member 30, 30' and attached plunger 60, 60' to rotate as the present invention is moved from the secured position to the open position. When the present invention is in the open position the arm member 37, 37' surpasses the guide member 50, 50' as shown in FIG. 2*c*.

E. Plunger and Sleeve

The plunger 60, 60' is preferably comprised of an elongated structure as shown in FIGS. 1 through 2*c*. The plunger 60, 60' is further comprised of a solid steel shaft structure. The plunger 60, 60' is pivotally attached to the connecting member 30, 30' via pivotally attaching a first plunger end 62, 62' to the second connecting end 32, 32' with a third fastener 69, 69'. The plunger 60, 60' is also able to rotate about the mounting plate 17 via rotation of the connecting member 30, 30'. The third fastener 69, 69' forms a third pivot axis about the present invention as shown in FIGS. 2*a* through 2*c*.

The plunger 60, 60' is positionable within a sleeve 70, 70', wherein the sleeve 70, 70' serves as a guide for the plunger 60, 60' to ensure that the plunger 60, 60' adjusts in a substantially vertical manner. The sleeve 70, 70' is comprised of a tubular configuration, wherein the sleeve 70, 70' also aligns with the first slot 19, 19' of the mounting plate 17. The plunger 60, 60' also extends through the sleeve 70, 70' and the first slot 19, 19' as shown in FIG. 4. The plunger 60, 60' also includes a lip 67, 67' positioned adjacent to the first plunger end 62, 62'. The lip 67, 67' engages the sleeve 70, 70' when the present invention is in the secured position.

Opposite the first plunger end 62, 62' of the plunger 60, 60' is preferably a second plunger end 63, 63'. The second plunger end 63, 63' extends through the first slot 19, 19' of the first flange 18 and subsequently through the second slot 15, 15' of the second flange 14 when securing the loader implement 13 to the skid steer loader. The second plunger end 63, 63' includes a cutaway portion 65, 65' or chamfer as shown in FIGS. 3*a* through 3*c*. The cutaway portion 65, 65' functions as both a cam to help align the first slot 19, 19' with the second slot 15, 15' when the connecting member 30, 30' and the plunger 60, 60' is rotating toward the secured position and also serves to prevent the loader implement 13 from being disengaged from the mounting plate 17 when not intended.

F. In Use

In use, the present invention is first ensured to be in the open position by lifting up on the handle portion 23, 23' of the lever 22, 22' until the arm member 37, 37' is positioned above the guide member 50, 50' as shown in FIG. 2*c*. The second flange 14 of the loader implement 13 may then be positioned underneath the first flange 18 of the mounting plate 17 so the second slots 15, 15' of the second flange 14 substantially align with the first slots 19, 19' of the first flange 18 as illustrated in FIGS. 1 and 4. Each loader attachment system 10 is now independently adjusted towards the secured position.

The handle portion 23, 23' of the lever 22, 22' is pushed downwards thus pivoting the lever 22, 22' about the first pivot axis, subsequently rotating the connecting member 30, 30' and the attached plunger 60, 60' about the lever 22, 22' by stretching the rotator spring 52, 52', also pivoting the connecting member 30, 30' about the lever 22, 22' and further pivoting the connecting member 30, 30' about the plunger 60, 60'. As the handle portion 23, 23' is oriented parallel with the top edge of the mounting plate 17 the connecting member 30, 30' moves toward a perpendicular orientation with the top edge of the mounting plate 17. The perpendicular orientation of the connecting member 30, 30' forces the plunger 60, 60' within the sleeve 70, 70' and through the first slot 19, 19' and through the second slot 15, 15' as shown in FIGS. 2*a* and 4.

The spring also forces the plunger 60, 60' and thus second plunger end 63, 63' to rotate within the slots thus helping to align the second slots 15, 15' properly with the first slots 19, 19' and provide a secure attachment between the loader implement 13 and the mounting plate 17 as shown in FIGS. 1 and 3*a*. The rotation of the cutaway portion 65, 65' further preferably mimics the rotation of a standard cam. As the present invention nears the secured position the securing portion 35, 35' of the stopper member 34, 34' engages the catch member 40, 40' as illustrated in FIGS. 1 and 2*a*. The stopper member 34, 34' thus prevents the connecting member 30, 30' from reverse rotating when in the secured position.

This same process is repeated for any other loader attachment systems 10 being utilized. To remove the loader implement 13 from the mounting plate 17 and skid steer loader the handle portion 23, 23' of the lever 22, 22' is simply lifted up as illustrated in FIGS. 2*a* through 2*c*. The stopper member 34, 34' is thus disengaged from the catch member 40, 40' and the arm member 37, 37' engages the guide member 50, 50'.

Upward and inward force upon the connecting member 30, 30' forces the arm member 37, 37' to slide up the guide member 50, 50'. The connecting member 30, 30', plunger 60, 60' and cutaway portion 65, 65' thus rotate. When the arm member 37, 37' reaches an upper end of the guide member 50, 50' the plunger 60, 60' is preferably rotated to a point wherein the cutaway portion 65, 65' allows for easy removal of the plunger 60, 60' from the first slots 19, 19' and the second slots 15, 15' as shown in FIG. 3*c*.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A loader attachment system for releasable attachment to an implement, comprising:

an upper assembly including an upper end and a lower end rotatable and pivotally mounted to said upper end, wherein said upper assembly is pivotally attached to a mounting plate;

a sleeve attached to said mounting plate;

a plunger pivotally attached to said lower end of said upper assembly, wherein said plunger extends within said sleeve for engaging said implement;

a first spring mechanically connected between said lower end and said mounting plate;

wherein said first spring mechanically rotates said plunger within said sleeve via rotation of said upper assembly.

2. The loader attachment system of claim 1, wherein said upper assembly includes a first pivot axis between said upper end and said mounting plate, a second pivot axis between said upper end and said lower end and a third pivot axis between said lower end and said plunger.

3. The loader attachment system of claim 1, wherein said plunger includes a first plunger end and a second plunger end, wherein said first plunger end is adjacent said upper assembly and wherein said second plunger end is opposite said upper assembly, wherein said second plunger end includes a chamfer.

4. The loader attachment system of claim 1, wherein said upper assembly includes a second spring positioned between said upper end and said lower end.

5. The loader attachment system of claim 1, wherein said upper assembly includes a stopper member extending from said lower end.

6. The loader attachment system of claim 5, wherein said stopper member includes a securing portion, wherein said securing portion is comprised of a saw tooth configuration.

7. The loader attachment system of claim 1, wherein said upper assembly includes an arm extending outwardly from said lower end and attached to said first spring.

8. The loader attachment system of claim 7, wherein a first longitudinal axis of said arm is substantially perpendicular to a second longitudinal axis of said lower end.

9. A loader attachment system for releasable attachment to an implement, comprising:

an upper assembly including an upper end and a lower end rotatable and pivotally mounted to said upper end, wherein said upper assembly is pivotally attached to a mounting plate;

a sleeve attached to said mounting plate;

a plunger pivotally attached to said lower end of said upper assembly, wherein said plunger extends within said sleeve for engaging said implement;

wherein said plunger includes a first plunger end and a second plunger end, wherein said first plunger end is adjacent said upper assembly and wherein said second plunger end is opposite said upper assembly;

wherein said second plunger end includes a chamfer; and a first spring mechanically connected between said lower end and said mounting plate, wherein said first spring mechanically rotates said plunger within said sleeve.

10. The loader attachment system of claim 9, wherein said plunger is rotatably connected to said upper end via said lower end.

11. The loader attachment system of claim 9, wherein said upper assembly includes a first pivot axis between said upper end and said mounting plate, a second pivot axis between said upper end and said lower end and a third pivot axis between said lower end and said plunger.

12. The loader attachment system of claim 9, wherein said upper assembly includes a second spring positioned between said upper end and said lower end of said upper assembly.

13. A loader attachment system for releasable attachment to an implement, comprising:

an upper assembly including an upper end and a lower end rotatable and pivotally mounted to said upper end, wherein said upper assembly is pivotally attached to a mounting plate;

a sleeve attached to said mounting plate;

a plunger pivotally attached to said lower end of said upper assembly, wherein said plunger extends within said sleeve and wherein said plunger slidably adjusts within said sleeve for engaging said implement; and a first spring mechanically connected between said lower end and said mounting plate, wherein said first spring mechanically rotates said plunger within said sleeve;

wherein said upper end is pivotally attached to said lower end;

wherein said upper assembly includes a first pivot axis between said upper end and said mounting plate, a second pivot axis between said upper end and said lower end and a third pivot axis between said lower end and said plunger;

wherein said plunger includes a first plunger end and a second plunger end, wherein said first plunger end is adjacent said upper assembly and wherein said second plunger end is opposite said upper assembly;

wherein said second plunger end includes a chamfer;

wherein said upper assembly includes a second spring positioned between said upper end and said lower end of said upper assembly;

wherein said lower end is pivotally attached to said upper end between said first spring and said second spring;

wherein said lower end is rotatably connected to said upper end and wherein said plunger is rotatably connected to said upper end via said lower end;

wherein said upper assembly includes a stopper member extending from said lower end and wherein said stopper member includes a securing portion;

wherein said securing portion is comprised of a saw tooth configuration;

wherein said upper assembly includes an arm extending outwardly from said lower end, wherein a first longitudinal axis of said arm is substantially perpendicular to a second longitudinal axis of said lower end and wherein said arm is attached to said first spring.

* * * * *